US007121542B2

(12) United States Patent
Okamoto

(10) Patent No.: US 7,121,542 B2
(45) Date of Patent: Oct. 17, 2006

(54) PAPER FEED DEVICE AND IMAGE FORMING APPARATUS

(75) Inventor: Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/810,670

(22) Filed: Mar. 29, 2004

(65) Prior Publication Data

US 2004/0251598 A1 Dec. 16, 2004

(30) Foreign Application Priority Data

Mar. 28, 2003 (JP) ..... 2003-092171

(51) Int. Cl.
*B65H 1/26* (2006.01)

(52) U.S. Cl. ..... 271/157; 414/795.4; 414/795.8; 221/227

(58) Field of Classification Search ..... 271/157; 414/795.4, 795.8; 221/227
See application file for complete search history.

(56) References Cited

U.S. PATENT DOCUMENTS 3,563,535 A * 2/1971 Vitu et al. ..... 271/157
6,805,344 B1 * 10/2004 Abe et al. ..... 271/157
2004/0036207 A1 * 2/2004 Lee et al. ..... 271/157

FOREIGN PATENT DOCUMENTS

| | | |
|---|---|---|
| JP | 3-256932 | * 11/1991 |
| JP | 6-72570 | * 3/1994 |
| JP | A 8-217266 | 8/1996 |
| JP | A-8-282862 | 10/1996 |
| JP | A-11-171352 | 6/1999 |
| JP | A-2000-344355 | 12/2000 |
| JP | A-2002-114388 | 4/2002 |

* cited by examiner

*Primary Examiner*—Gene Crawford
*Assistant Examiner*—Thomas Morrison
(74) *Attorney, Agent, or Firm*—Oliff & Berridge, PLC

(57) ABSTRACT

A paper feed device includes a setting plate, a support unit, a driving unit, a power transmission mechanism, a link mechanism, and an operation lever. The support unit elevatably supports the setting plate, and elevates the setting plate when the support unit receives a driving force. The driving unit drives the support unit. The power transmission mechanism transmits the driving force from the driving unit to the support unit. The operation lever is switched between a first state and a second state. When the operation lever is in the first state, the power transmission mechanism transmits the driving force to the support unit. When the operation lever is in the second state, the link mechanism cuts off the transmission of the driving force to the support unit.

16 Claims, 7 Drawing Sheets

PAPER FEED DEVICE AND IMAGE FORMING APPARATUS

BACKGROUND OF THE INVENTION

1. Field of the Invention

The present invention relates to an image forming apparatus such as a printer, a facsimile machine or a copying machine and to a paper feed device for supplying paper to the image forming apparatus.

2. Description of the Related Art

As a paper feed device for supplying paper to an image forming apparatus such as a printer, a facsimile machine or a copying machine, there has been known a device having a configuration in which a setting plate having sheets of paper stacked thereon is suspended with a wire rope or the like to allow a large amount of sheets of paper to be stored and in which the wire rope is wound by means of a motor or the like to elevate the setting plate to control the uppermost surface of the sheets of paper at a predetermined elevation for feeding sheets of paper.

In this type paper feed device, since a paper feed unit such as a pickup roller abuts on the uppermost surface of the sheets of paper placed on the setting plate, the setting plate elevated by the motor or the like needs to be once moved down in order to supply sheets of paper.

In the related-art paper feed device, therefore, the setting plate is elevatably provided in a paper cassette, which can be attached/detached to/from the image forming apparatus. When the paper cassette is removed from the image forming apparatus, the setting plate in the paper cassette is separated from a driving shaft of a motor in the image forming apparatus so that the setting plate can go down because of its own weight (JP-A-Hei. 8-217266).

SUMMARY OF THE INVENTION

There is however a demand for reduction in size of the image formation apparatus. It is conceived that the paper feed device is formed without use of any paper cassette in order to reduce the size of the paper feed device. That is, the paper feed device is directly incorporated in the body of the image forming apparatus to dispense with any mechanism for attaching/detaching the paper cassette to/from the image forming apparatus to thereby attain reduction in size of the image forming apparatus.

However, when the paper feed device is formed without use of any paper cassette, the setting plate cannot be moved down through the action of removing the paper cassette as described above.

On the other hand, it may be conceived that current conduction of the motor is cut off in order to move down the setting plate incorporated in the body of the image forming apparatus. In this method, there is however the possibility that the setting plate may not be moved down or a long time may be required for moving down the setting plate because of friction in a driving system.

Another possible method to solve the problem is to operate a switch or the like to reverse the motor to move down the setting plate when paper supply is required. This method, however, has a problem that a circuit for reversing the motor is required or paper supply cannot be made when the apparatus is supplied with no power.

The invention is developed in consideration of the problems. An object of the invention is to provide a paper feed device including a setting plate, which is placed sheets of paper thereon and is elevatably incorporated in an image forming apparatus, so that the elevation of the setting plate is controlled by a motor or the like, in which the setting plate can be moved down quickly in spite of simple configuration when sheets of paper are supplied.

According to an embodiment of the invention, a paper feed device includes a setting plate, a support unit, a driving unit, a power transmission mechanism, a link mechanism, and an operation lever. A plurality of sheets of paper are placed on the setting plate. The support unit elevatably supports the setting plate, and elevates the setting plate when the support unit receives a driving force. The driving unit drives the support unit so that a uppermost sheet of paper placed on the setting plate is positioned at a predetermined height for feeding the sheets of paper. The power transmission mechanism transmits the driving force from the driving unit to the support unit. The link mechanism cuts off the transmission of the driving force to the support unit. The operation lever is switched between a first state and a second state. When the operation lever is in the first state, the power transmission mechanism transmits the driving force to the support unit. When the operation lever is in the second state, the link mechanism cuts off the transmission of the driving force to the support unit. The support unit is disengaged from the driving unit by an operation of the link mechanism. According to the embodiment of the invention, an image forming apparatus includes a paper feed device and a recording device. The paper feed device feeds a sheet of paper. The recording device forms an image on the sheet of paper fed from the paper feed device. The paper feed device includes a setting plate, a support unit, a driving unit, a power transmission mechanism, a link mechanism, and an operation lever. A plurality of sheets of paper are placed on the setting plate. The support unit elevatably supports the setting plate, and elevates the setting plate when the support unit receives a driving force. The driving unit drives the support unit so that a uppermost sheet of paper placed on the setting plate is positioned at a predetermined height for feeding the sheets of paper. The power transmission mechanism transmits the driving force from the driving unit to the support unit. The link mechanism cuts off the transmission of the driving force to the support unit. The operation lever is switched between a first state and a second state. When the operation lever is in the first state, the power transmission mechanism transmits the driving force to the support unit. When the operation lever is in the second state, the link mechanism cuts off the transmission of the driving force to the support unit. The support unit is disengaged from the driving unit by an operation of the link mechanism.

According to the embodiment, the paper feed device includes a setting plate, a support unit, a power transmission mechanism, a link mechanism, and an operation lever. A plurality of sheets of paper are placed on the setting plate. The support unit elevatably supports the setting plate, and elevates the setting plate when the support unit receives a driving force. The power transmission mechanism transmits a driving force, supplied from external, to the support unit. The link mechanism cuts off the transmission of the driving force to the support unit. The operation lever is switched between a first state and a second state. When the operation lever is in the first state and the driving force is supplied from the external, the power transmission mechanism transmits the driving force to the support unit. When the operation lever is in the second state, the link mechanism cuts off the transmission of the driving force to the support unit. The support unit is disengaged from the driving unit by an operation of the link mechanism.

DETAILED DESCRIPTION OF THE PREFERRED EMBODIMENTS

An embodiment of the invention will be described below with reference to the drawings.

Figure 1:
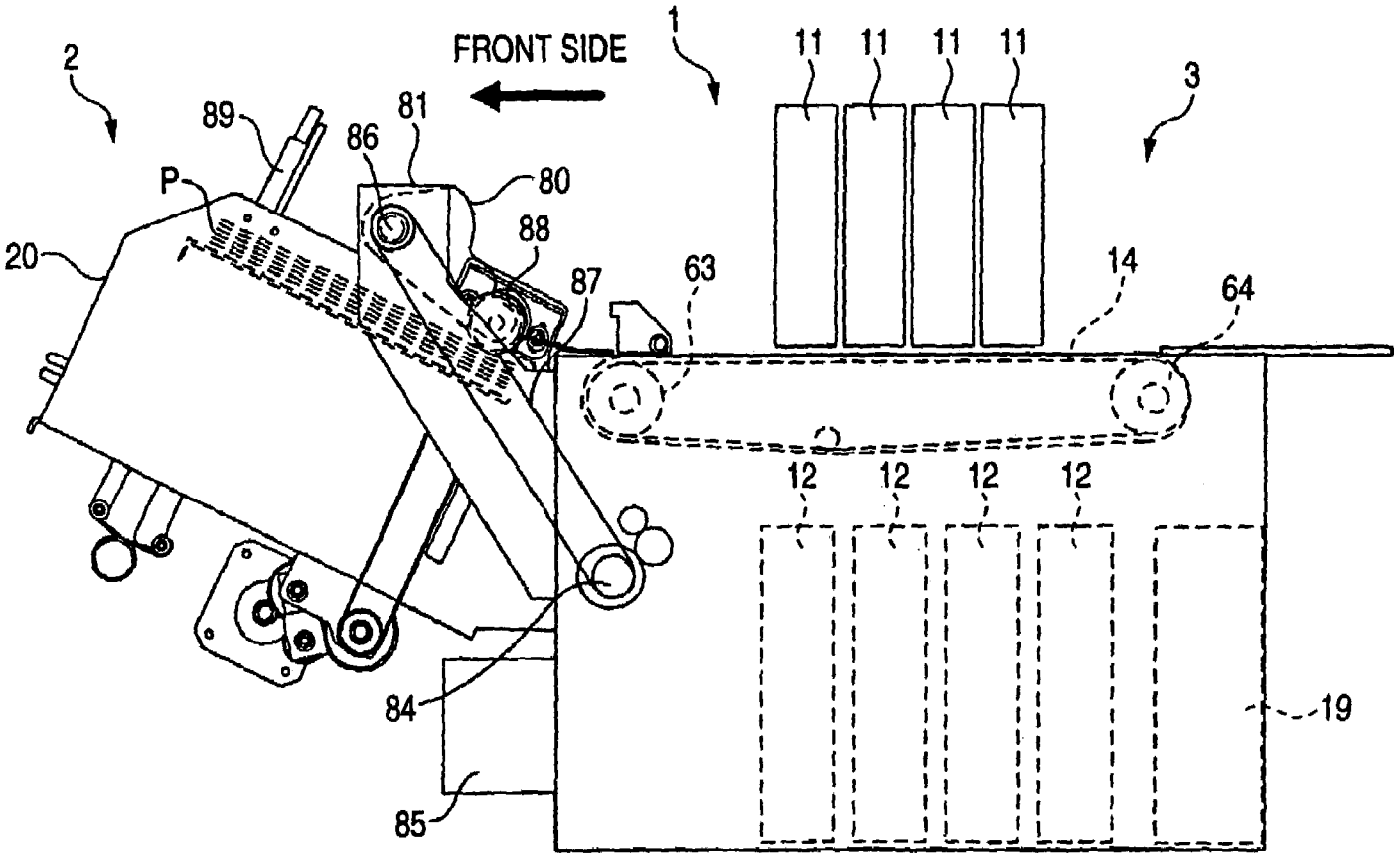
FIG. 1 is a schematic side view of an ink jet printer having a paper feed device according to an embodiment of the invention.

FIG. 1 is a schematic side view showing an overall internal configuration of an ink jet printer 1 including a paper feed device 2 according to an embodiment of the invention.

The ink jet printer 1 includes the paper feed device 2, which supplies sheets of paper P one by one, and a recording device 3, which prints images on the sheets of paper P supplied by the paper feed device 2. The side on which the paper feed device 2 is attached (i.e., the left side in FIG. 1) is the front side of the ink jet printer 1.

Figure 2:
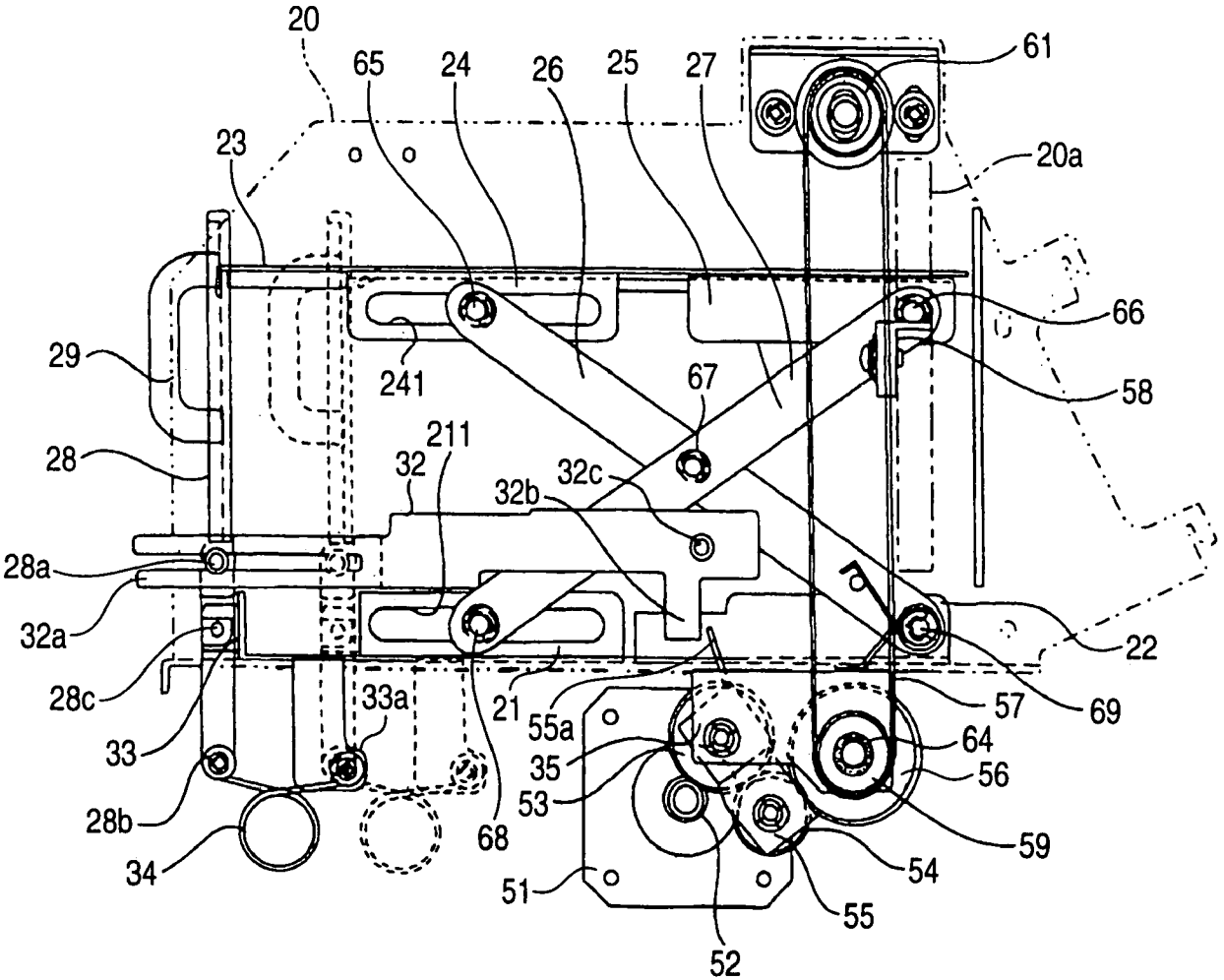
FIG. 2 is a side view of the paper feed device according to this embodiment in the case where a setting plate is moved up.
Figure 3:
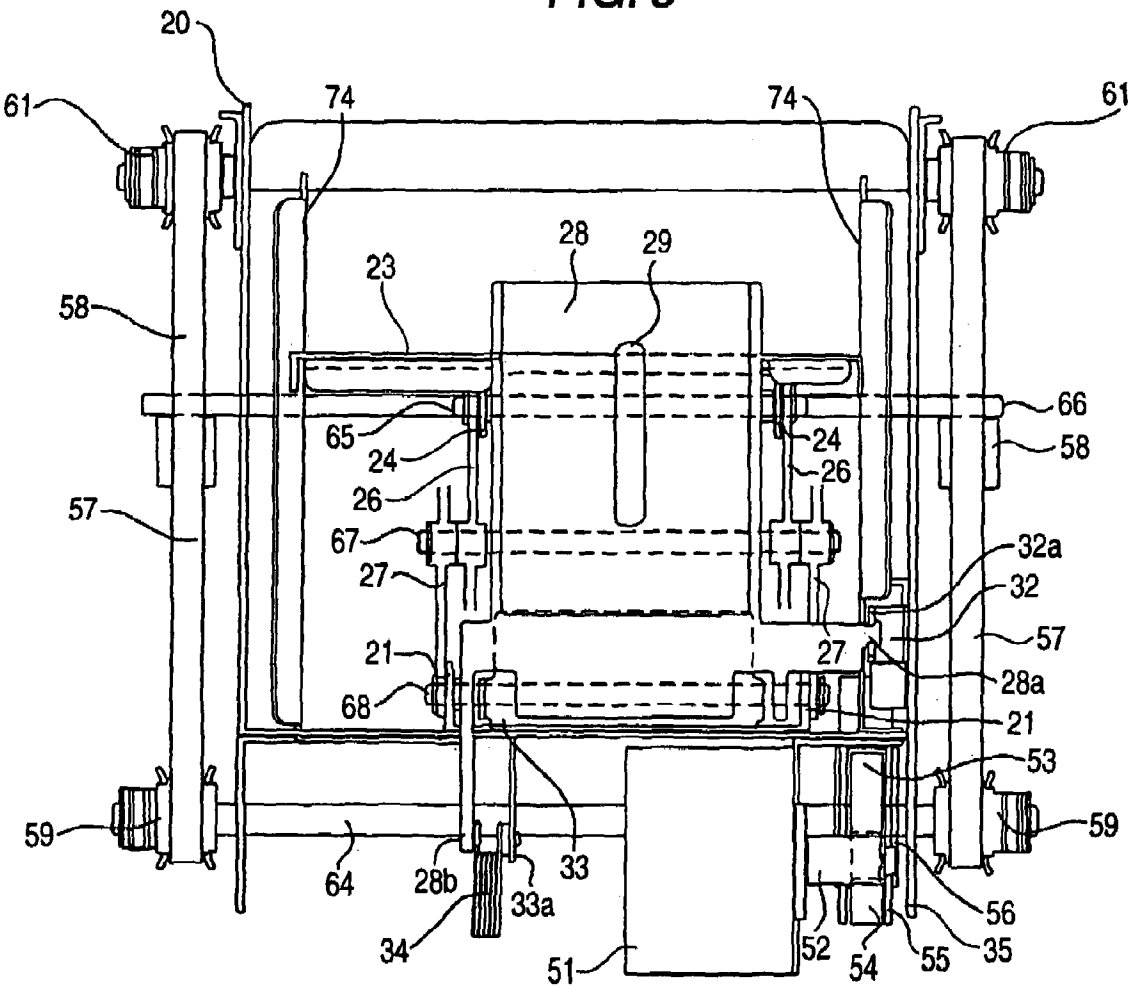
FIG. 3 is a front view of the paper feed device according to this embodiment in the case where the setting plate moves up.

As shown in FIG. 1, the paper feed device 2 includes a paper feeder chassis 20, a pickup roller section 80, and a sensor 89. As shown in FIGS. 2 and 3, which are a side view and a front view of the paper feeder chassis 20, the paper feeder chassis 20 includes a setting plate 23 on which sheets of paper are placed, support beams 26 and 27, a paper stopper 28, a stepping motor 51, a gear 52, a sun gear 53, a planet gear 54, a gear fixing plate 55, a gear 56, power transmission belts 57, and a gear releasing plate 32.

FIGS. 2 and 3 are views showing a state in which a surface of the setting plate 23 on which sheets of paper P are to be placed is made horizontal after the paper feeder chassis 20 of the paper feed device 2 is removed from the ink jet printer 1. The state after removal of the paper feeder chassis 20 is shown in FIG. 2 for facilitating understanding of the internal structure of the paper feed device 2.

The paper feeder chassis 20 is substantially shaped like a box having opened front and top sides. The paper feeder chassis 20 is attached to the recording device 3 in the condition that the paper feed chassis 20 is inclined so that the recording device 3 side of the paper feed chassis 20 is lower than the opposite side.

For example, the setting plate 23 is a flat plate having a size to allow sheets of postcard-size paper P to be placed thereon. A pair of left and right flanges 24 and a pair of left and right flanges 25 are provided at the front and rear sides of the bottom of the plate, respectively. A pair of left and right flanges 21 and a pair of left and right flanges 22 are provided in the paper feeder chassis 20 so as to be opposite to the pairs of flanges 24 and 25, respectively. The distance between the left and right flanges 21 is equal to the distance between the left and right flanges 25. The distance between the left and right flanges 22 is equal to the distance between the left and right flanges 24 and narrower than the distance between the left and right flanges 21. Each of the flanges 21 is pierced by a long hole 211 which is formed to extend in the front-rear direction in parallel with the surface of the setting plate 23 on which sheets of paper are placed. Similarly, each of the flanges 24 is pierced by a long hole 241 which is formed to extend in the front-rear direction in parallel with the surface of the setting plate 23 on which sheets of paper are placed. Each of the flanges 22 is pierced by a circular hole. Similarly, each of the flanges 25 is pierced by a circular hole.

A pair of left and right support beams 26 and a pair of left and right support beams 27, each of which is made of a rod-like plate material, are inserted in the holes of the flanges 22, 24 and 21, 25 through rotating shafts 65, 69 and 66, 68 so that the pair of support beams 26 and the pair of support beams 27 cross each other between the setting plate 23 and the bottom of the paper feeder chassis 20 to support the setting plate 23. That is, each of the support beams 26 has one end fixed to the rotating shaft 69 rotatably supported in the holes of the flanges 22, and the other end fixed to the rotating shaft 65 movably and rotatably inserted in the long holes 241 of the flanges 24. Each of the support beams 27 has one end fixed to the rotating shaft 66 rotatably supported in the holes of the flanges 25, and the other end fixed to the rotating shaft 68 movably and rotatably inserted in the long holes 211 of the flanges 21. The shaft distance between the rotating shafts 65 and 69 for the support beams 26 is selected to be equal to the shaft distance between the rotating shafts 66 and 68 for the support beams 27. The pairs of support beams 26 and 27 are rotatably connected to each other through the rotating shaft 67 in the center position of the shaft distance.

Accordingly, the setting plate 23 is supported through the support beams 26 and 27 so as to be substantially parallel with the bottom of the paper feeder chassis 20 and movable in the up-down direction.

Incidentally, the length of the rotating shaft 66 is larger than the width of the paper feeder chassis 20, so that the rotating shaft 66 protrudes from long holes 20*a*, which are provided in sides of the paper feeder chassis 20 to extend in the up-down direction.

The stepping motor 51 is a motor, which rotates by an angle corresponding to the number of pulses in a pulse voltage received from the outside. The stepping motor 51 is provided with the gear 52 disposed on a driving shaft of the motor. The stepping motor 51 is attached to the bottom of the paper feeder chassis 20 from below.

The gear 52 engages with the sun gear 53. The sun gear 53 engages with the planet gear 54. The planet gear 54 is held by the gear fixing plate 55 so that the planet gear 54 revolves around the sun gear 53. The planet gear 54 engages with the gear 56 when the planet gear 54 is at a predetermined angular position relative to the sun gear 53.

A rotating shaft 64 is rotatably supported through the left and right sides of the paper feeder chassis 20. The gear 56 is fixed to the rotating shaft 64. Toothed pulleys 59 are fixed to opposite ends of the rotating shaft 64, respectively. The power transmission belts (timing belts) 57 are stretched between the toothed pulleys 59 and toothed pulleys 61 provided in the left and right of the top portion of the paper feeder chassis 20 located above the pulleys 59, respectively.

Support bodies 58 to form horizontal protrusions are provided in the middle of the power transmission belts 57.

Respective top surfaces of the support bodies 58 abut on the rotating shaft 66 protruding from the long holes 20*a* in left and right sides of the paper feeder chassis 20, from below.

The paper stopper 28 is made of a plate-like member substantially shaped like a rectangle. A paper stopper knob 29 having a shape allowed to be gripped by a user is provided in the center of a plate surface of the paper stopper 28.

A paper stopper holding portion 33, which is a plate bent so as to be L-shaped, is fixed to the paper feeder chassis 20 so that the paper stopper holding portion 33 can move back and forth in parallel with the left-right direction in the condition that one part of the bent shape abuts on the bottom of the paper feeder chassis 20 while the other part of the bent shape faces upward.

The paper stopper 28 is mounted so as to be rotatable at a lower end portion 28*c* of the paper stopper 28 so that the paper stopper 28 is changed from an "erected state" to an "open state". In the "erected state", the upward bent part of the paper stopper holding portion 33 makes the plate surface of the paper stopper 28 be substantially perpendicular to the bottom of the paper feeder chassis 20. In the "open state", the plate surface of the paper stopper 28 is inclined at 90 degrees in the forward direction so as to be substantially parallel with the bottom of the paper feeder chassis 20. The paper stopper 28 has a protrusion 28*a*, which is provided at a position far from the lower end portion 28*c* held by the paper support holding portion 33 and protrudes in a direction parallel with the lower end portion 28*c*.

The gear releasing plate 32 is made of a plate member substantially shaped like a rectangle. The gear releasing plate 32 has one end formed as a fork portion 32*a* forked into two parts, and the other end rotatably attached to the paper feeder chassis 20 at a fixed portion 32*c* located substantially above the gear fixing plate 55. The protrusion 28*a* of the paper stopper 28 is sandwiched between the two parts of the fork portion 32*a*. Incidentally, the fork portion 32*a* has a forked shape having such a length that the protrusion 28*a* can be sandwiched between the two parts of the fork portion 32*a* regardless of the rotation of the paper stopper 28 and the back-and-forth movement of the paper stopper holding portion 33.

The gear releasing plate 32 has a protrusion 32*b*, which extends downward. On the other hand, an upper portion of the gear fixing plate 55 has a protrusion 55*a*, which extends upward. The protrusions 32*b* and 55*a* are disposed so that the protrusion 32*b* abuts against the protrusion 55*a* when the protrusion 32*b* rotates counterclockwise in FIG. 2.

The paper stopper holding portion 33 has a flange 33*a* protruding downward from the bottom of the paper feeder chassis 20. A side lower end portion 28*b* similar to the flange 33*a* is provided at a lower end of the paper stopper 28. A torque spring 34 is suspended between the flange 33*a* and the side lower end portion 28*b*. Incidentally, the flange 33*a* and the side lower end portion 28*b* are disposed so that an isosceles right triangle is drawn by points at which the torque spring 34 is fixed to the flange 33*a* and the side lower end portion 28*b* and a point of the lower end portion 28*c* at which the paper stopper 28 is held when the paper stopper 28 is in the "erected state". In this arrangement, even when the paper stopper 28 is in the "open state", a symmetric isosceles right triangle can be drawn to thereby make the mount distance of the torque spring 34 equal to that in the "erected state". When the paper stopper 28 is at in any other position than the two positions, the distance between the fixed positions of the torque spring 34 changes so that the torque spring 34 generates torque. For this reason, the paper stopper 28 is kept in either of the "erected state" and the "open state" when the paper stopper 28 is not moved by a user.

Lateral paper stoppers 74 each shaped like a flat plate for aligning the sheets of paper P stacked on the setting plate 23 in the left-right direction in the paper feeder chassis 20 are provided on the bottom of the paper feeder chassis 20 so as to be movable in the left-right direction.

The pickup roller section 80 is attached to the recording device 3 through a frame 81 so as to be located above the paper feeder chassis 20. When the sheets of paper Pare at a predetermined elevation, the pickup roller section 80 urges a roller 88 to press against the sheets of paper P. When a motor 85 of the recording device 3 rotates, a pulley 86 is rotated by a power transmission belt 87 through a gear 84 rotated by the rotation of the motor 85. As a result, the roller 88 in contact with a sheet of paper P is rotated, so that the sheet of paper P is fed to the recording device 3 side.

The sensor 89 is a photosensitive position sensor, which applies light onto the sheet of paper P perpendicularly, detects light reflected from the sheet of paper P and outputs a signal corresponding to the distance to the sheet of paper P in accordance with the intensity of the light.

Next, the operation of the paper feed device 2 in each state of the paper stopper 28 will be described.

When the paper stopper 28 is in the "erected state", the protrusion 28*a* is located in a vertical direction with respect to the rotating shaft of the paper stopper 28. Accordingly, the fork portion 32*a* of the gear releasing plate 32 is at the highest position whereas the protrusion 32*b* of the gear releasing plate 32 pivoting on the fixed portion 32*c* is in the foremost position.

At this time, the protrusion 32*b* and the protrusion 55*a* of the gear fixing plate 55 do not abut against each other any more. When the stepping motor 51 rotates clockwise in FIG. 2, the gear 52 rotates clockwise, the sun gear 53 rotates counterclockwise, and the planet gear 54 revolves around the sun gear 53 counterclockwise along with the gear fixing plate 55 and engages the gear 56. Then, the gear 56 is rotated counterclockwise by the planet gear 54, and rear-side parts of the power transmission belts 57 are moved up through the toothed pulleys 59. Thus, the support bodies 58 move up, and the rotating shaft 66 is lifted up accordingly to move up the setting plate 23.

Figure 4:
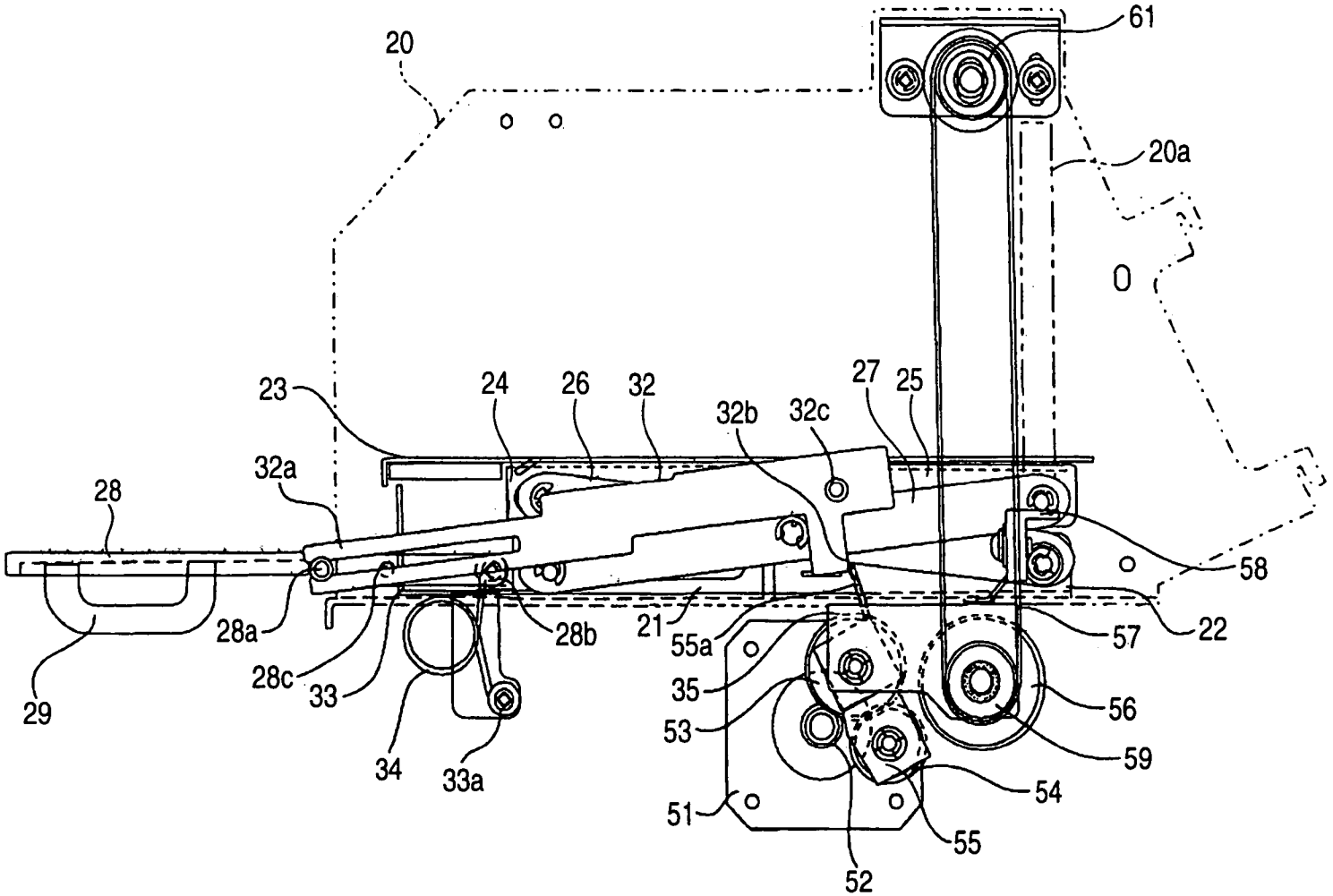
FIG. 4 is a side view of the paper feed device according to this the embodiment in the case where the setting plate moves down.

When the paper stopper 28 is operated to enter the "open state", the protrusion 28*a* moves forward and downward while drawing a circular locus as shown in FIG. 4. As a result, the fork portion 32*a* of the gear releasing plate 32 is moved down, and the protrusion 32*b* rotates counterclockwise about the fixed portion 32*c*. Thus, the protrusion 32*b* and the protrusion 55*a* of the gear fixing plate 55 abut against each other, and the protrusion 55*a* is pressed rearward. Then, the gear fixing plate 55 rotates clockwise to disengage the planet gear 54 from the gear 56. As a result, the setting plate 23 loses the retaining force given by the stepping motor 51 and goes down because of its own weight.

On the other hand, the recording device 3 includes a paper transport belt 14 for transporting a sheet of paper supplied by the paper feed device 2, ink cartridges 12 in which four kinds of color ink, i.e., cyan, magenta, yellow, and black are reserved respectively, four ink jet heads 11 for printing the four kinds of color ink on the sheet of paper P, and a control section 19 for performing various kinds of control.

The paper transport belt 14 has its surface having viscosity sufficient to hold the sheet of paper P without any slip during transportation. As shown in FIG. 1, the paper transport belt 14 is stretched between a driving roller 63 and a driven roller 64. The driving roller 63 rotates so that the sheet of paper P fed from the paper feed device 2 is transported so as to pass underneath the ink jet heads 11.

Each of the ink jet heads 11 has ejection holes through which ink is ejected when a pressure wave is generated in each nozzle by vibration of a piezoelectric element. The ejection holes are arranged to cover the width of the sheet of paper P in the paper transporting direction. Ink corresponding to one row in the direction of the width of the sheet of paper P is ejected at once to perform printing. This makes high-speed printing possible.

The control section 19 controls the amounts of the four kinds of ink ejected from the ink jet heads 11, the operation of the motor 85 for driving the pickup roller section 80, the operation of the driving roller 63 and the operation of the stepping motor 51 of the paper feed device 2 according to external image signals received from a personal computer or the like.

As described above, the control section 19 of the recording device 3 drives the stepping motor 51 to move up the setting plate 23 so that the distance to the sheet of the paper P which distance is detected by the sensor 89 of the paper feed device 2 reaches the elevation (i.e., a preset elevation) at which the sheet of paper P can be picked up by the pickup roller section 80. When image data are input from the outside, the control section 19 drives the motor 85 to rotate the roller 88 of the pickup roller section 80 to feed one sheet of paper onto the paper transport belt 14, and drives the driving roller 63 to transport the sheet of paper P just under the ink jet heads 11 through the paper transport belt 14. The four kinds of ink reserved in the ink cartridges 12 are ejected from the ink jet heads 11 according to the image data while the sheet of paper P is transported, so that an image is formed on the sheet of paper P.

As described above, in the paper feed device 2 according to the embodiment of the invention, a driving force is transmitted from the stepping motor 51 to the setting plate 23 when the paper stopper 28 is in the "erected state", so that the setting plate 23 is held at a position to allow feeding of the uppermost one of sheets of paper placed on the setting plate 23. On the other hand, when the paper stopper 28 is pulled forward so as to be in the "open state", the planet gear 54 is disengaged from the gear 56, so that the setting plate 23 moves down because the setting plate 23 cannot be held at that elevation any more.

For this reason, the paper stopper 28 can be ordinarily set in the "erected state" to allow the setting plate 23 to be lifted up. When paper supply is required, the paper stopper 28 can be pulled so as to be in the "open state" and the setting plate 23 can be moved down to make paper P supply possible.

When the paper stopper 28 is pulled forward so as to be in the "open state", the paper stopper 28 can be retracted from sheets of paper P, so that sheets of paper P can be supplied from the front shown in FIG. 1. In this manner, the operation of supplying sheets of paper can be made easily because the action of descending the setting plate 23 and the action of retracting the paper stopper 28 can be performed simultaneously.

When the positions of the paper stopper holding portion 33 and the lateral paper stoppers 74 are changed, sheets of paper different in size can be stored In the paper feed device 2 of the embodiment, the paper stopper 28 can align one end edges of the sheets of paper. That is, a function, which is required for a paper stopper plate, for aligning the sheets of paper in the paper feed device 2 can be implemented by the paper stopper 28. It is therefore possible to eliminate a space for provision of an operation lever and reduce the number of components. Advantageously, this leads to reduction in size of the image forming apparatus 1.

In the embodiment, sheets of paper can be supplied when inserted in a direction lateral to the setting plate 23 in a condition that the paper feed section 80 is located above the setting plate 23. In this case, it is necessary to move the paper stopper plates 74 provided on both sides of the sheets of paper. If a state where the paper stopper plates 74 are moved is chosen as the "open state" to block the transmission path of the driving force, the operation of moving the paper stopper plate 74 and the operation of moving down the setting plate 23 can be performed with a single action.

As should be appreciated, the protrusions 32*b*, 55*a* are an example of a link mechanism and the paper stopper 28 and knob 29 are an example of an operation lever. As discussed above, the paper stopper 28 is changed to switch power transmission. However, power transmission may also be switched through an operation of changing a direction of another component or by an exclusive lever. Therefore, the paper stopper 28 is an example of an operation lever that may be operated to switch power transmission. Additionally, the knob 29 may be provided at a center of a plate surface of the paper stopper 28. A shape of the knob 29 may allow a user to grip the knob 29 so that the paper stopper 28 may be changed to switch power transmission. Therefore, the combination of the paper stopper 28 and the knob 29 are an example of an operation lever that may be operated to switch power transmission.

As discussed above, the paper stopper 28 may be positioned in an erected state, e.g., a first state, or an open state, e.g., a second state. When the paper stopper 28 is operated to enter the erected state, the downwardly extending protrusion 32*b* of a gear releasing plate 32 does not abut against the protrusion 55*a* of a gear fixing plate 55. As a result, power transmission belts 57 transmit a driving force that moves support bodies 58 upward to lift a rotating shaft 66 and a setting plate 23

When the paper stopper 28 is operated to enter the open state, the protrusion 32*b* and the protrusion 55*a* abut against each other to cut off the transmission of a retaining force from a stepping motor 51 to support the setting plate 23, and the gear 56 of the support is disengaged from the planet gear 54 of the stepping motor 51. Because the abutment of the protrusion 32*b* and the protrusion 55*a* cut off the transmission of a driving force to support the setting plate 23, the protrusion 32*b* and the protrusion 55*a* are an example of a link mechanism.

Modification

Although the embodiment of the invention has been described above, the invention is not limited to the specific embodiment but may be carried out in various modes.

Although this embodiment has been described on the case where the position of the planet gear 54 is changed by the gear fixing plate 55 to thereby switch the transmission of power from the stepping motor 51 to the power transmission belts 57, the invention may be also applied to a case where the transmission of power is switched by another method. For example, configuration may be made so that a dry type clutch for opening/closing the gap between the gears 52 and 56 in accordance with the angle of the gear releasing plate 32 is provided.

Although this embodiment has been described on the case where the direction of the paper stopper 28 is changed to thereby switch power transmission, the invention may be also applied to a case where power transmission is switched through an operation of changing the direction of another component or to a case where an exclusive lever is provided for switching power transmission. However, this embodiment is preferred because it requires a smaller number of components and a smaller space for equipment.

(Modification 2)

In the embodiment, the paper feeder chassis 20 includes the step motor 51 the driving force of which is transmitted via the gears 52, 53, 54 to the gear 56, thereby to drive the power transmission belts 57. However, the step motor 51 may be omitted and the driving force of the motor 85 provided in the recording device 3 may be used via the gear 84 to drive the power transmission belts 57. A specific example of this modification will be described below with reference to FIGS. 5–7.

Figure 5:
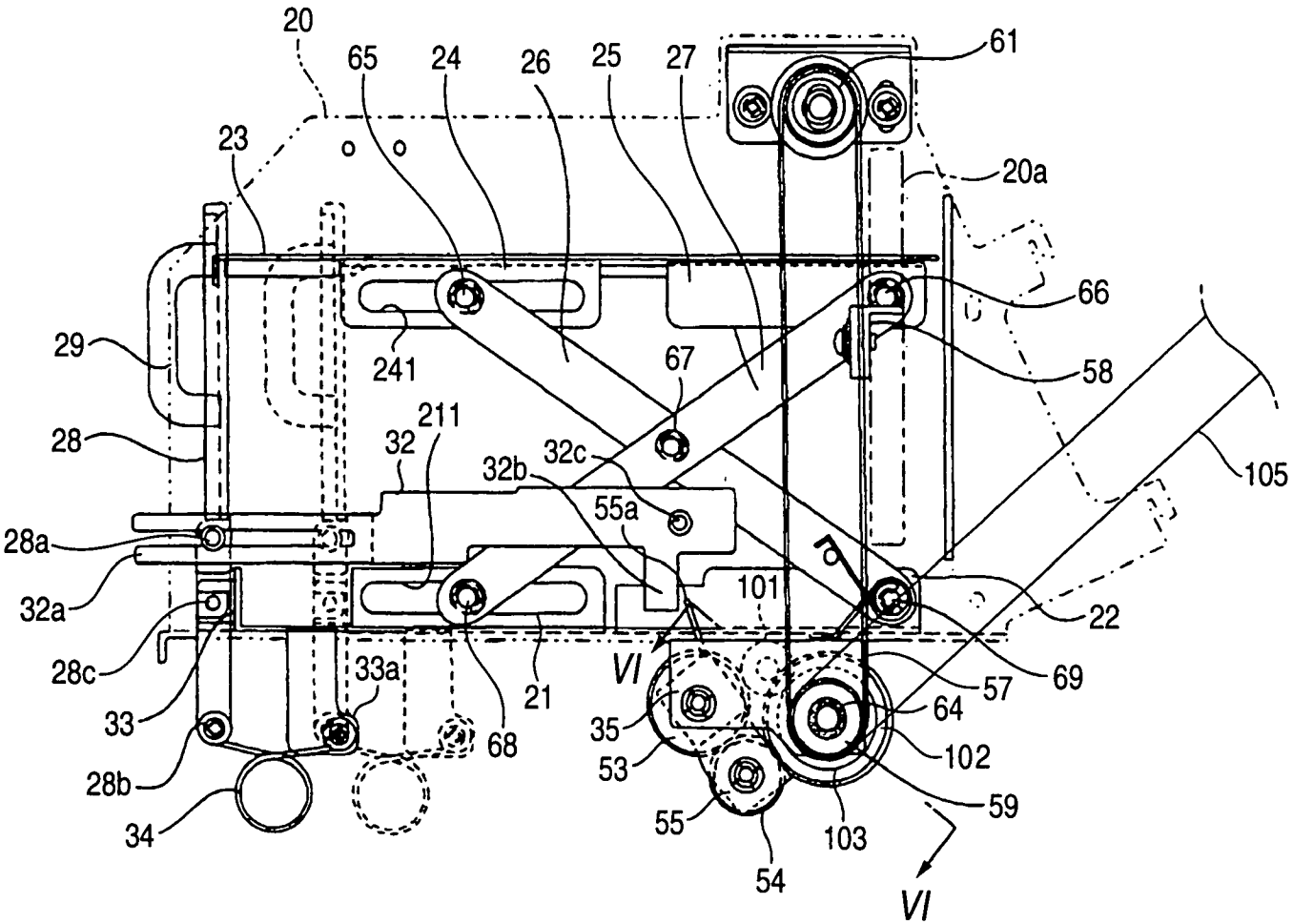
FIG. 5 is a side view of a paper feed device 100 according to a modification.
Figure 6:
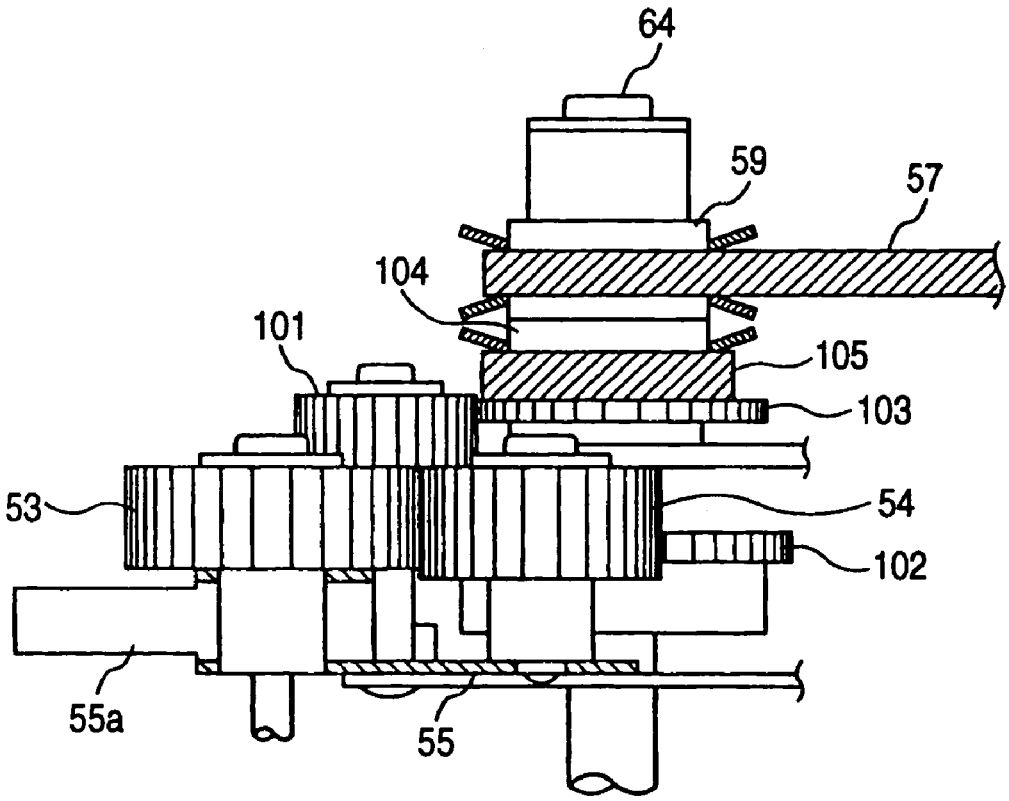
FIG. 6 is a section view of the paper feed device 100 taken along a line VI—VI in FIG. 5.
Figure 7:
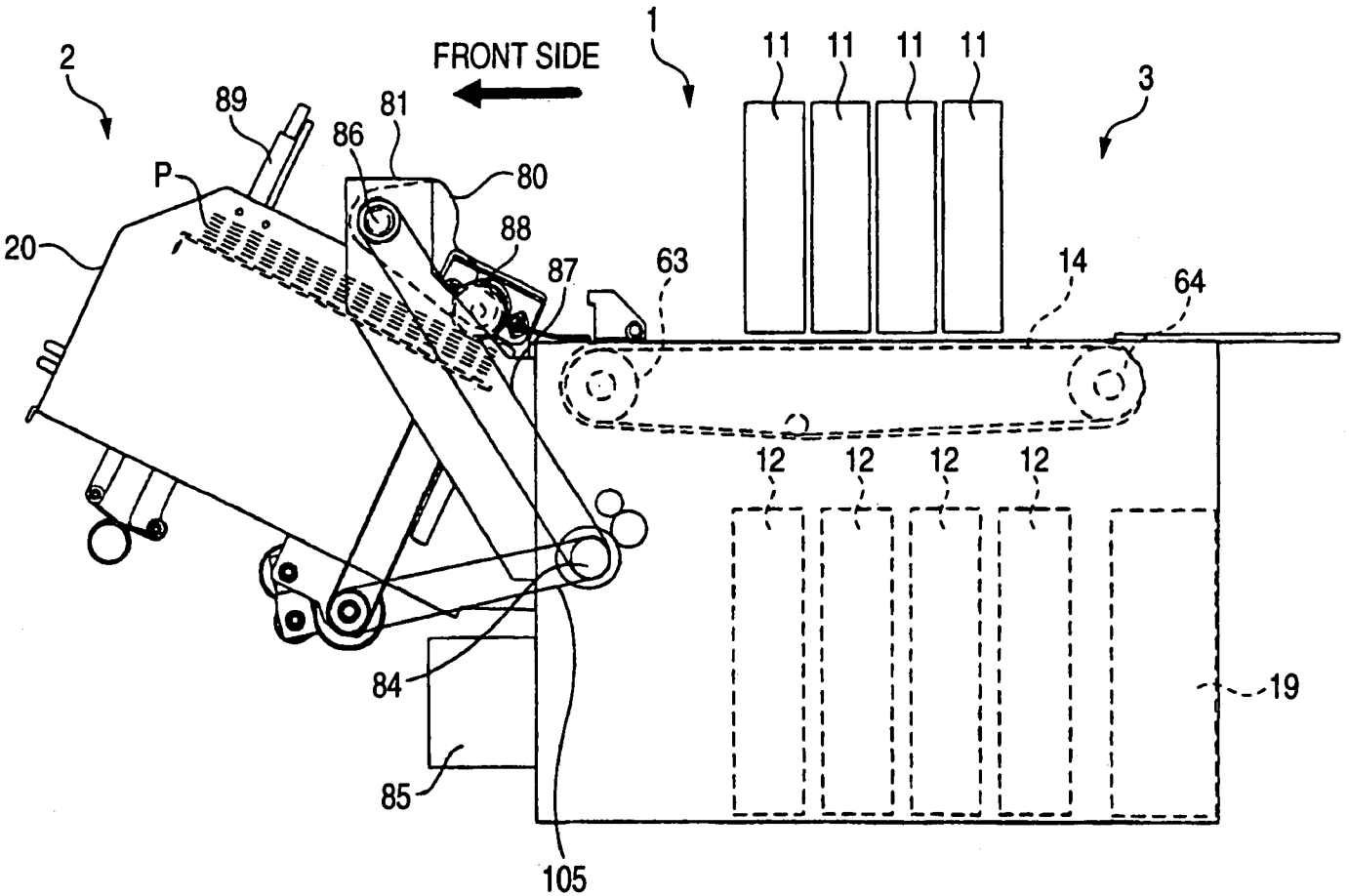
FIG. 7 is a schematic side view of an inkjet printer having the paper feed device 100 according to the modification of the invention.

In the following description, parts similar to those in the embodiment will be assigned the same reference numerals and description thereto will be omitted. FIG. 5 is a side view of a paper feed device 100 according to this modification. FIG. 6 is a section view of the paper feed device 100 taken along a line VI—VI in FIG. 5. The paper feeder chassis 20 includes the sun gear 53, the planet gear 54, the gear fixing plate 55, the power transmission belts 57, an idle gear 101, a gear 102, a gear 103, and toothed pulleys 104. The gear 103 engages with the idle gear 101. The idle gear 101 engages with the sun gear 53. The planet gear 54 engages with the gear 102 when the planet gear 54 is at a predetermined angular position relative to the sun gear 53. A power transmission belt (timing belt) 105 is stretched between the gear 84 and the toothed pulley 104. When the rotating shaft 64 rotates, the toothed pulleys 59 and the gear 102 are rotated together with the rotating shaft 64, and vice versa. On the other hand, the toothed pulley 104 is attached to the rotating shaft 64 via a bearing (not shown). Thus, the rotation shaft 64 and the toothed pulley 104 rotate independently of each other. Incidentally, the toothed pulley 104 is formed with the gear 103 integrally as shown in FIG. 6. The gear 84 is configured as follows. When the motor 85 rotates the gear 84 clockwise, the gear 84 moves the power transmission belt 87, but does not move the power transmission belt 105. On the other hand, when the motor 85 rotates the gear 84 counterclockwise, the gear 84 moves the power transmission belt 105, but does not move the power transmission belt 87. In order to implement this configuration, the gear 84 may have a clutch mechanism such as one-way clutches.

Next, an operation of the paper feed device 100 according to this modification will be described. First, consider that the paper stopper 28 is in the "erected state". At this time, the protrusion 32*b* and the protrusion 55*a* of the gear fixing plate 55 do not abut against each other. If the motor 85 rotates the gear 84 clockwise, the gear 84 rotates the pulley 86 clockwise through the power transmission belt 87. The pick up roller 88 contacting with the uppermost sheet of paper P is rotated counterclockwise. Since the gear 84 does not move the power transmission belt 105, the driving force of the motor 85 is not transmitted to the power transmission belts 57. However, when the paper stopper 28 is in the "erected state", the planet gear 55 engages with the gear 102. Thus, the power transmission belts 57 are not moved. As a result, the setting plate 23 does not move downward, but can keep its height. Accordingly, the pickup roller 88 can pick up and feed the sheet of paper P to the recording device 3.

When the motor 85 rotates the gear 84 counterclockwise and the paper stopper 28 is in the "erected state", the gear 84 rotates the toothed pulley 104 and the gear 103 counterclockwise through the power transmission belt 105. The idle gear 101 is rotated clockwise; the sun gear 53 rotated counterclockwise; the planet gear 54 is rotated clockwise; and the gear 102 is rotated counterclockwise. As a result, the rear-side parts of the power transmission belts 57 are moved upward. Thus, the support bodies 58 move up, and the rotating shaft 66 is lifted up to move up the setting plate 23. Since the gear 84 does not move the power transmission belt 87 at this time, the pickup roller 88 does not rotate during the setting plate 23 is moving up.

If the paper stopper 28 is changed from the "erected state" to the "open state", the protrusion 32*b* and the protrusion 55*a* of the gear fixing plate 55 abut against each other in a similar manner to the embodiment. Thus, the protrusion 55*a* is pressed rearward. Then, the gear fixing plate 55 rotates clockwise to disengage the planet gear 54 from the gear 102. As a result, since the rotating shaft 64 becomes rotating freely, the setting plate 23 loses the retaining force given through the power transmission belts 57 and goes down because of its own weight.

What is claimed is:

1. A paper feed device, comprising:

a setting plate on which a plurality of sheets of paper are placed;

a support unit which elevatably supports the setting plate, and elevates the setting plate when the support unit receives a driving force;

a power transmission mechanism engageable with the support unit to transmit the driving force to the support unit;

a driving unit operatively connected to the power transmission mechanism to provide the driving force via the power transmission mechanism to the support unit so that a uppermost sheet of paper placed on the setting plate is positioned at a predetermined height for feeding the sheets of paper;

a link mechanism that includes a first portion and a second portion, the first portion connected to the power transmission mechanism to cut off the transmission of the driving force to the support unit; and an operation lever operatively connected to the second portion of the link mechanism, the operation lever being switched between a first state and a second state, wherein:

when the operation lever is in the first state, the power transmission mechanism transmits the driving force to the support unit;

when the operation lever is in the second state, the link mechanism disconnects the power transmission mechanism from the support unit to cut off the transmission of the driving force to the support unit.

2. The paper feed device according to claim 1, wherein when the operation lever is in the first state, the operation lever abuts against an end edge of each of the sheets of paper placed on the setting plate to align the end edge of each of the sheets of paper.

3. The paper feed device according to claim 2, wherein when the operation lever is in the first state, a position where the operation lever abuts against the sheets of paper is adjustable.

4. The paper feed device according to claim 1, wherein:

the support unit includes a power-receiving gear, which moves up the setting plate when the power-receiving gear is rotated in one direction;

the power transmission mechanism includes:

a sun gear rotated by the driving unit; and a planet gear, which revolves around the sun gear;

the planet gear engages with the power-receiving gear when the operation lever is in the first state; and the planet gear is disengaged from the power-receiving gear when the operation lever is in the second state.

5. The paper feed device according to claim 1, wherein when the operation lever is switched from the first state to the second state, the setting plate goes down due to weight of the setting plate.

6. The paper feed device according to claim 1, wherein when the operation lever is in the second state, a user is capable of stacking additional sheets of paper on the setting plate.

7. The paper feed device according to claim 1, wherein:

when the operation lever is in the first state, the operation lever is substantially perpendicular to the setting plate; and when the operation lever is in the second state, the operation lever is substantially parallel to the setting plate.

8. An image forming apparatus, comprising:

a paper feed device which feeds a sheet of paper; and a recording device which forms an image on the sheet of paper fed from the paper feed device, wherein:

the paper feed device includes:

a setting plate on which a plurality of sheets of paper are placed;

a support unit which elevatably supports the setting plate, and elevates the setting plate when the support unit receives a driving force;

a power transmission mechanism engageable with the support unit to transmit the driving force to the support unit;

a driving unit operatively connected to the power transmission mechanism to provide the driving force via the power transmission mechanism to the support unit so that a uppermost sheet of paper placed on the setting plate is positioned at a predetermined height for feeding the sheets of paper;

a link mechanism that includes a first portion and a second portion, the first portion connected to the power transmission mechanism to cut off the transmission of the driving force to the support unit; and an operation lever operatively connected to the second portion of the link mechanism, the operation lever being switched between a first state and a second state;

when the operation lever is in the first state, the power transmission mechanism transmits the driving force to the support unit;

when the operation lever is in the second state, the link mechanism disconnects the power transmission mechanism from the support unit to cut off the transmission of the driving force to the support unit.

9. A paper feed device, comprising:

a setting plate on which a plurality of sheets of paper are placed;

a support unit which elevatably supports the setting plate, and elevates the setting plate when the support unit receives a driving force;

a power transmission mechanism engageable with the support unit to transmit the driving force, which may be supplied from an external driving unit, to the support unit;

a link mechanism that includes a first portion and a second portion, the first portion connected to the power transmission mechanism to cut off the transmission of the driving force to the support unit; and an operation lever operatively connected to the second portion of the link mechanism, the operation lever being switched between a first state and a second state, wherein:

when the operation lever is in the first state and the driving force is supplied from the external driving unit, the power transmission mechanism transmits the driving force to the support unit;

when the operation lever is in the second state, the link mechanism disconnects the power transmission mechanism from the support unit to cut off the transmission of the driving force to the support unit.

10. The paper feed device according to claim 9, wherein when the operation lever is in the first state, the operation lever abuts against an end edge of each of the sheets of paper placed on the setting plate to align the end edge of each of the sheets of paper.

11. The paper feed device according to claim 10, wherein when the operation lever is in the first state, a position where the operation lever abuts against the sheets of paper is adjustable.

12. The paper feed device according to claim 9, wherein when the operation lever is in the first state and the driving force is not supplied from the external driving unit, the support unit and the power transmission mechanism maintain a height of the setting plate.

13. The paper feed device according to claim 9, wherein:

the support unit includes a power-receiving gear, which moves up the setting plate when the power-receiving gear is rotated in one direction;

the power transmission mechanism includes:

a sun gear rotated by the driving force supplied from the external driving unit; and a planet gear, which revolves around the sun gear;

the planet gear engages with the power-receiving gear when the operation lever is in the first state; and the planet gear is disengaged from the power-receiving gear when the operation lever is in the second state.

14. The paper feed device according to claim 9, wherein when the operation lever is switched from the first state to the second state, the setting plate goes down due to weight of the setting plate.

15. The paper feed device according to claim 9, wherein when the operation lever is in the second state, a user is capable of stacking additional sheets of paper on the setting plate.

16. The paper feed device according to claim 9, wherein:

when the operation lever is in the first state, the operation lever is substantially perpendicular to the setting plate; and when the operation lever is in the second state, the operation lever is substantially parallel to the setting plate.

* * * * *